United States Patent [19]

Scholl et al.

[11] Patent Number: 4,580,509

[45] Date of Patent: Apr. 8, 1986

[54] AUTOMATIC SEWING MACHINE

[75] Inventors: Hans Scholl, Oerlinghausen-Lipperreihe; Siegfried Vogt, Leopoldshöhe, both of Fed. Rep. of Germany

[73] Assignee: Kochs Adler, AG, Fed. Rep. of Germany

[21] Appl. No.: 672,278

[22] Filed: Nov. 16, 1984

[30] Foreign Application Priority Data

Nov. 11, 1983 [DE] Fed. Rep. of Germany ..... 3340865

[51] Int. Cl.[4] ..... D05B 23/00; D05B 33/00

[52] U.S. Cl. ..... 112/2; 112/10; 112/121.29; 112/153; 112/272; 112/121.11

[58] Field of Search ..... 112/2, 10, 11, 121.29, 112/130, 136, 153, 272, 121.11, 121.12

[56] References Cited

U.S. PATENT DOCUMENTS

| | | | |
|---|---|---|---|
| 2,423,080 | 7/1947 | Belcher | 112/11 |
| 2,492,925 | 12/1949 | Segur | 112/2 X |
| 2,685,664 | 8/1954 | Visconti | 112/130 X |
| 3,345,963 | 10/1967 | Shoaf | 112/121.29 |
| 3,413,942 | 12/1968 | Scholl | 112/2 |
| 3,670,679 | 6/1972 | Campbell | 112/10 X |
| 3,854,430 | 12/1974 | Bryan | 112/121.11 |

*Primary Examiner*—H. Hampton Hunter

*Attorney, Agent, or Firm*—Laff, Whitesel, Conte & Saret

[57] ABSTRACT

An automatic sewing machine installed with a sewing head and a feeding device is disclosed for successively sewing workpieces which are flexibly connnected to one another by a thread chain. The feeding device is arranged with a workpiece holder for receiving the workpiece and guiding the latter according to the extension of a seam situated in the workpiece.

In order to simplify automatic sewing processes in front of the sewing head, there is arranged a reel carrying workpieces still to be provided with the seam. Behind the sewing head there is arranged a reel for receiving the sewn workpieces. The reel installed in front of the sewing head is stationarily arranged in a position relative to the workpiece holder. Between the sewing head and the reel arranged behind the sewing head there is installed a further feeding device.

12 Claims, 9 Drawing Figures

II
78
1
2
3
4
5
6
7
8
9
10
11
13
14
15
16
18
21
25
26
27
28
29
30
31
32
33
34
35
36
38
39
41
43
47
48
49
50
52
53
62
63
64
65
67
68
69
72
76
77

VI
VII
VII
89
87
83
65'
4
88
90
91
82
81
39
40
28
31
30'
47'
51'
49'
48'
36
3
84
93
92
85
5
6
86
78
55
32'

AUTOMATIC SEWING MACHINE

FIELD OF THE INVENTION

The present invention generally relates to a sewing machine for sewing successive workpieces, which, in particular are connected to one another by a thread chain.

BACKGROUND OF THE INVENTION

U.S. Pat. No. 3,413,942 discloses a sewing machine having a device for winding sewn workpieces connected to one another by thread chains. This winding device makes it possible to store a large number of sewn workpieces leaving the sewing machine without the danger of entanglement. Thus, the workpieces may be separated from one another with a small expenditure of time when the sewing machine is inoperative. The construction of the sewing device includes a sewing machine mounted displaceably on link arms in order to be moved along the circumference of a turntable installed with workpiece holders and guide templates by the coaction of the latter with a non-intermittently driven magnetic roller. As the turntable continues to rotate a thread chain is produced so that the successively sewn workpieces are connected to one another. The such connected workpieces then are wound on vertical rods as parts of a rotary body rotate about a vertical axis. At equal angular sectioning of the turntable and the rotary body, the device may be used also to remove sorted workpieces, e.g. workpieces of different patterns.

From the U.S. Pat. No. 2,492,925 it is known to successively sew workpieces and to even connect them to one another at a first work station by keeping the sewing machine running when a workpiece is not present. The connected workpieces are then fed to a second work station by means of a chute. At this work station a further workpiece is stitched to the first one as also a further thread chain is formed.

Due to the kind of transport the positions of the workpieces are maintained, i.e. order and sequence are maintained. After termination of sewing the workpieces connected to one another by thread chains are then stored, for example in a carton.

From the U.S. Pat. No. 3,670,679 it is known to wind an endless tape of cuff lining material off a reel. Behind the reel there are arranged two stacks in order to place on cuff cuts. A first sewing machine stitches the cuts of cuffs onto the tape of cuff lining material. A second sewing machine stitches the cut of cuff adjacent to the tape onto the tape of cuff lining as a succeeding operation. Subsequently this endless tape is wound up again on a reel.

SUMMARY OF THE INVENTION

It is a main object of the present invention to create a sewing machine which renders possible to automatically carry out a sewing operation in workpieces which are connected to one another by a thread chain.

It is a further object of this invention to propose an automatic sewing machine of the aforesaid character wherein the sewn workpieces are kept in order and sequence.

A further object of this invention is to provide an automatic sewing machine of the said type at which the sewn product is wound up on a reel as a stack respectively storage means or magazine for succeeding processes.

Still a further object of this invention is to propose an automatic sewing machine of the aforesaid type which is simple in construction and reliable in operation.

Other objects, advantages and features of the present invention will appear from the detailed description of the preferred and modified embodiments which now will be explained in conjunction with the accompanying drawings.

DESCRIPTION OF THE PREFERRED AND MODIFIED EMBODIMENTS

Figure 1:
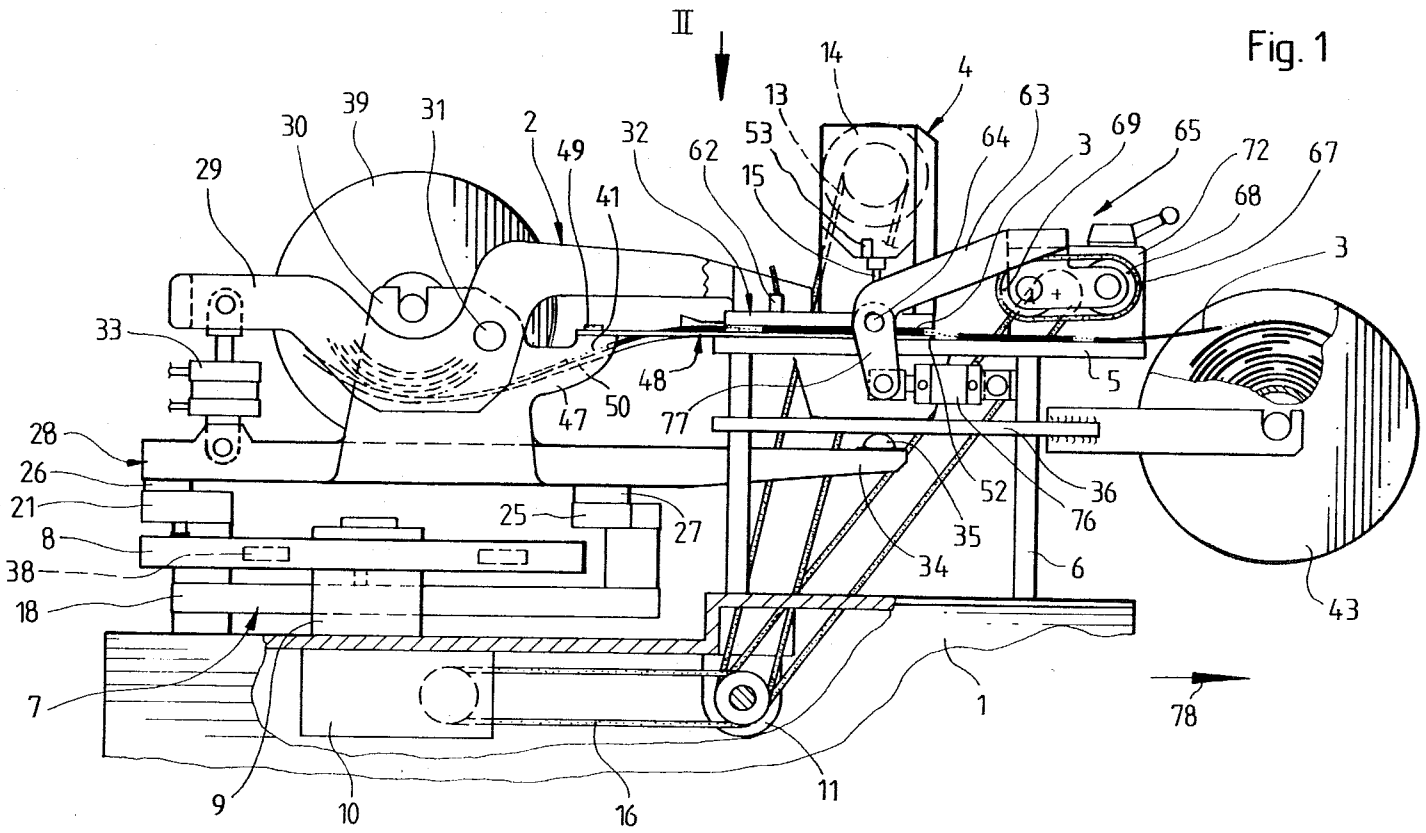
FIG. 1 is a partially broken open longitudinal side elevation of an automatic sewing machine according to the invention and according to the arrow I in FIG. 2.

Referring to FIGS. 1–4 of the drawings there is illustrated an automatic sewing machine mounted on a stand 1 having a plate 5, which is secured thereto by means of posts 6 for receiving a feeding device 2 for a workpiece 3 and a sewing head 4.

The feeding device 2 is provided with a linkage system 7, which, in principle, consists of a parallelogram linkage cooperating with a control disc 8. The control disc 8 is secured to an off-drive shaft 9 of a gear 10 mounted at the stand 1 and driven by a drive motor 11 of the automatic sewing machine also mounted inside the stand 1. The motor 11 is connected to a handwheel 14 of the sewing head 4 via a clutch 12 and a belt drive 13 for driving—depending on whether the clutch 12 is engaged—a needle bar 15. The needle bar is on the sewing head 4 and carries a needle 57. The drive motor 11 is drivingly connected via a further belt drive 16 to the gear 10.

Figure 2:
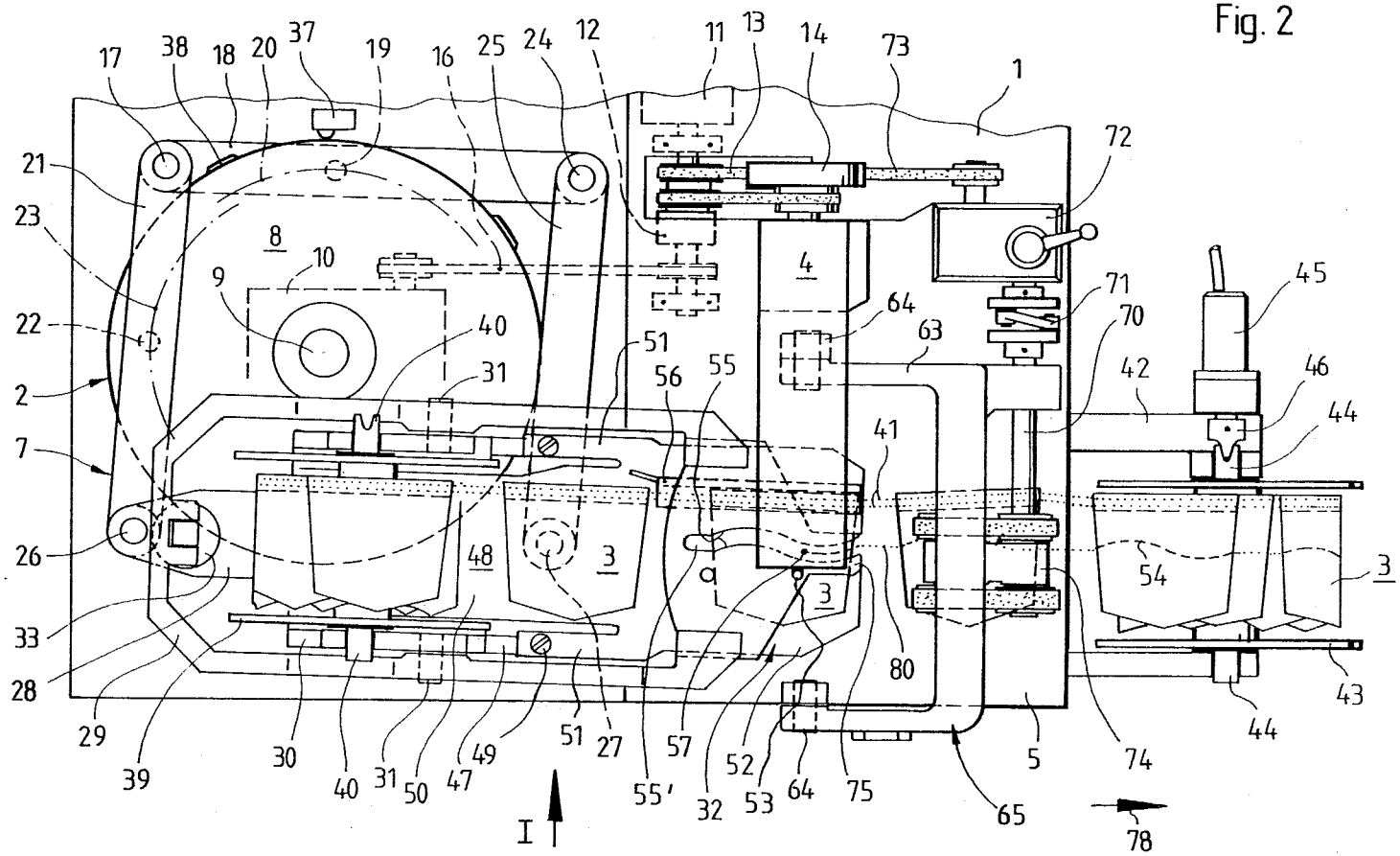
FIG. 2 is a top plan view of the automatic sewing machine according to the arrow II in FIG. 1, at which a non-relevant portion is omitted.

Referring to FIG. 2, the linkage system 7 is provided with a fixed fulcrum formed by an axle 17, secured to the stand 1. A guide lever 18 is swingably supported at the axle 17 and arranged below the control disc 8 parallel to the main direction of the sewing head 4. The guide lever 18 has a guide roller 19 that engages a control groove 20 formed in the lower surface of the control disc 8.

A further or second guide lever 21 is swingably supported at the axis 17 and arranged above the control disc 8 perpendicularly with respect to the lower guide lever 18, and parallel to the main direction of the sewing head 4. Guide lever 21 has a downwardly projecting guide roller 22 that engages a control groove 23 formed in the upper surface of the control disc 8. The control grooves 20, 23 extend as closed grooves along the total periphery of the control disc 8, of course they are not circularly profiled.

The other end of the lower guide lever 18 is hinged to one end of the intermediate lever 25 via a link 24. The intermediate lever 25 extends parallel to the upper guide lever 21 and is above the control disc 8. An off drive lever 28 is connected to the other end of the upper guide lever 21 and the other end of the intermediate lever 25 via links 26, 27. The off-drive lever 28 extends parallel to the lower guide lever 18 and is located above the plane formed by the upper guide lever 21 and the intermediate lever 25. The linkage system 7 defined by the four joints 17, 24, 26, 27 is a parallelogram-link-system having nearly right angles and equal shanks.

A bearing block 30 and a supporting arm 29 are secured to the off-drive lever 28. The supporting arm 29 is swingable about a horizontal axis 31, which extends parallel to the main direction of the sewing head 4. A workpiece holder 32 is mounted on the free or front end of the supporting arm 29.

The supporting arm 29 is swingable by means of a pneumatic piston-cylinder-tilt-drive 33, which is mounted to the off-drive lever 28 and the supporting arm 29. When pressurized, the drive 33 will be shortened, so that the workpiece holder 32 is tilted upwardly from the operative position also illustrated in the drawing into a not illustrated position. The off-drive lever 28 has a counter-thrust-arm 34 extending below the workpiece holder 32. A supporting roller 35 on the counter-thrust-arm 34 abuts against a pressure plate 36 mounted to the posts 6. This ensures that sufficient pressing forces are available when the workpiece holder 32 is lowered for sewing, i.e. the drive 33 is an extended position. A fixed electrical switch 37 is attached to the stand 1. The switch 37 cooperates with cams 38 secured to the outer periphery of the control disc. This causes transmission of an electrical signal to an electronical controller at a determined angle position of the control disc 8.

In the bearing block 30, a removable first reel 39 is pivoted about axle journals 40. The removable reel 39 receives a plurality of workpieces 3, which are connected together by a thread chain 41. The thread chain 41 is achieved by successively doing the same sewing procedure or individual workpieces, i.e. after termination of the seam at one workpiece, the sewing machine continues sewing until the beginning of the seam at the next following workpiece. Consequently, the individual workpieces 3 are each positioned to each other in the same position along the thread chain 41. On the stand 1 to the side of the sewing head 4 opposite the reel 39, a projecting bearing block 42 is fastened. The projecting bearing block 42 supports a sound removable take-up reel 43 by axle journals 44. After termination of the still hereinafter described sewing operations, the take-up reel 43 receives the workpieces connected together by a seam. The reel 43 is driven by a motor 45 secured via a clutch 46 and one axle journal 44 and constantly imparting a slight torque to the reel 43.

On both sides of the reel 39 there are arms 47 projecting from the bearing block 30 in the direction to the sewing head 4. A guiding device 48 is connected to the arms 47 by screws 49. This guiding device 48 is substantially bent from resilient thin sheet metal and provided with a longer resilient guiding section 50 reaching below the reel 39 and resting against the workpieces 3 received by the reel 39. Parallel to the guiding section 50 there are formed webs 51 over cutouts. The webs 51 are secured by the screws 49 to the arms 47. Adjacent to the guiding section 50 and continuous therewith is formed a supporting plate 52 extending below the sewing head 4. The workpieces 3 each to be sewn are clamped to the supporting plate 52 by the workpiece holder 32 which forms a clamping plate. The workpiece holder 32 is secured to the front end of the supporting arm 29 embracing the reel 39 like a fork. A recess 55 profiled according to the contour of the seam 54 to be produced is formed in the workpiece holder 32. The supporting plate 52 also has formed thereon a corresponding recess so that the supporting plate is moved together with the workpiece holder 32. The supporting plate 52 is provided with a guiding canal 56 having a rectangular hollow profile and a slot 58 at the side turned to the needle bar 15. As the double seam 59 (which also formed the thread chain 41 in a preceding operation) fixes a hem 60 through a plurality of material layers, the hem 60 may be guided in the guiding canal 56. The workpiece 3 is led throughout the slot 58, so that the individual workpieces 3 are positioned transversally with respect to the guiding canal 56 and are well-positioned with respect to the needle 57. In order to facilitate the feeding of the individual workpieces 3 into the guiding canal 56, there is provided a feed hopper 61 opened at the side turned to the reel 39. For the detection of the leading edge 95 of the workpiece 3 the sewing head 4 is provided with a stationary sensor 53 in the area of the needle 57.

To the workpiece holder 32 there is attached a sensor 62, i.e. a reflecting light barrier sensing the arrival of the trailing edge 79 of the workpiece 3. This sensor 62 defines the correct position of each workpiece 3 to be sewn in the main feed direction from the reel 39 to the reel 43 relatively to the workpiece holder 32, while the guiding canal 56 defines the position in cross direction relatively to the reel 39, 43 and the exact angle position.

Figure 3:
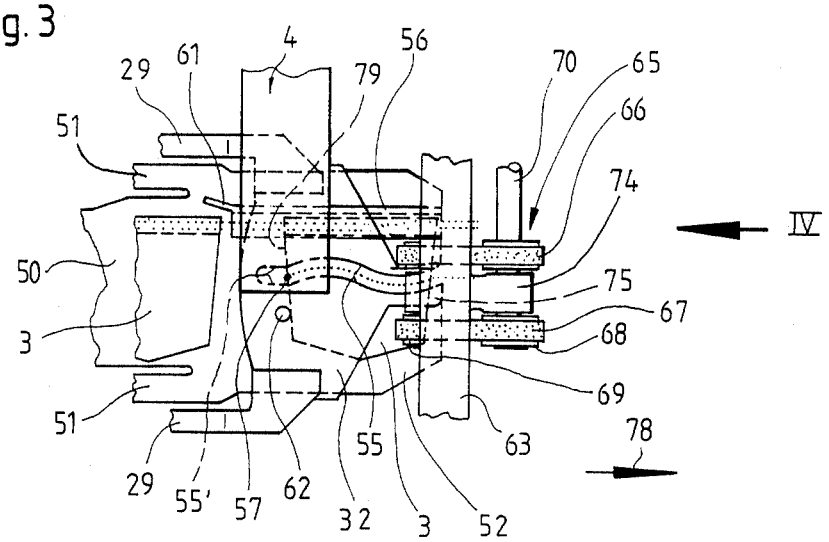
FIG. 3 is a partial area according to FIG. 2 showing a later phase of operation.
Figure 4:
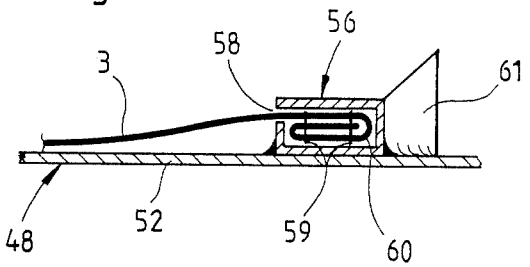
FIG. 4 is a partially sectional view according to the arrow IV in FIG. 3.

A bracket is pivotally or swingably supported in stationary bearings 64 above the plate 5. A bracket 63, to which is mounted a feeding device 65, consist of two separately arranged conveyor belts 66, 67 each guided via driven roller 68 and a freewheeling roller 69. The driven rollers 68 are driven by a steplessly adjustable gear 72 via a shaft 70 and a clutch 71. The gear 72 in turn is driven by the drive motor 11 via a belt drive 73. The rollers 68, 69 are supported in a bearing body 74 secured to the bracket 63. The bracket 63 and the conveyor 65 are arranged in such a manner so that the conveyor belts 66, 67 may engage the finished workpiece 3 which have the seam 54. In this position two relatively small sections 75 of the workpiece holder 32 are located between the conveyor belts 66, 67 as illustrated in FIG. 3. The sections 75 are formed by the recess or slot formed in the workpiece holder. Consequently, according to FIG. 2 the workpiece 3 is engaged at the areas located on both sides of the sections 75.

A pneumatic drive 76 is provided below the plate 5 in order to move the feeding device 65 out of a conveying position. The pneumatical pivot drive 76 effects, via a lever arm 77, the movement between an upper end position as illustrated in FIG. 1 and a lower conveying position.

Operation of the preferred embodiment is described as follows:

According to FIG. 2 a workpiece 3—in this case a pocket cut is fed by the reel 39 to the workpiece holder 36 positioned below the sewing head 4. The needle 57 has already stitched a portion of the seam 54 to be produced. The drive motor 11 drives via the clutch 12 the control disc 8, the sewing head 4 and gear 72. During the sewing operation the conveyor 65 is lifted from the plate 5 and located in the position as illustrated in FIG. 1, so that no conveying effect is imparted by the conveyor belts 66, 67 to the workpieces 3. Feeding of the workpiece 3, which is sewn at this instant, is achieved via the workpiece holder 32 driven by the linkage system 7 according to the contour of the seam 54 to be produced, i.e. to the profile of the recess 55. The seam 54 is finished when the trailing edge 79 of the workpiece 3 succeeding in the main feed direction, is reached as indicated by the sensor 62. Here, the recess 55 has a straight section 55, in which, while the workpiece holder 32 is further moved rectilinearly the sewing head 4 is still sewing to produce a thread chain 80.

The stitch length of the thread chain 80 depends on the feed rate of the feeding device 65 adjustable by the gear 72.

When the sensor 62 indicates that the trailing edge 79 is reached, the cam 38 triggers via the switch 37 a signal to the pivot drive 76 to be shifted to lower the bracket 63 together with the feeding device 65 to engage the workpiece 3 at both sections 75 of the workpiece holder 32 as illustrated in FIG. 3. By a correspondent actuation of the drive 33, the workpiece holder 32 is lifted and the just sewn workpiece 3 is released. By advancing the just sewn workpiece 3 into the direction 78, the next workpiece 3 follows, while the slightly lifted workpiece holder 32 is returned into its workpiece receiving position. In case the following workpiece 3 has been advanced, while forming the thread chain 80, before the workpiece holder 32 has reached its retracted take-over-position, the stationary sensor 53 triggers the disengagement of the clutch 12. Thus, the sewing head 4 and the feeding device 65 will be stopped temporarily, until the workpiece holder 32 has reached its retracted position. The finished workpieces 3 are received by the reel 43, to which steadily is imparted a slight torque.

Figures 5, 6, 7:
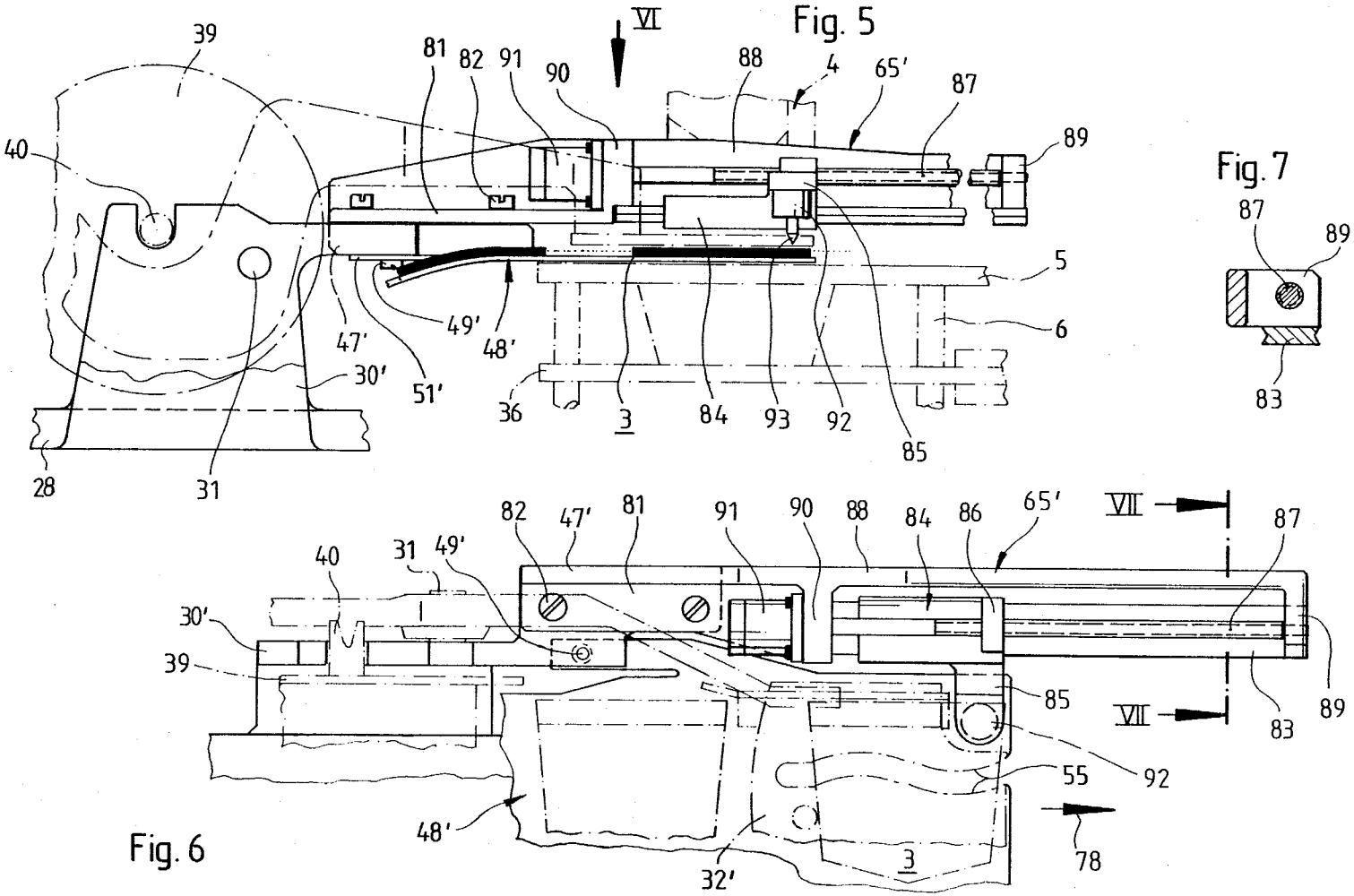
FIG. 5 is a partially longitudinal side elevation of a modified embodiment of the automatic sewing machine.
FIG. 6 is a partial top plan view of the automatic sewing machine according to FIG. 5 and according to the arrow VI of FIG. 5.
FIG. 7 is a partial cross section taken along line VII—VIII in FIG. 6.

The embodiment according to FIGS. 5–7, a different construction and mode of operation of the feeding device 65 is shown. A bearing block 30′ mounted to the off-drive lever 28 and carrying the reel 39 is formed with arms 47′. The arms 47′ extend to the sewing head 4. Webs 51′ of the guiding device 48′ are secured to the lower surface of the arms 47′ by means of screws 49′. One arm 47′ illustrated in FIG. 6 is as wide as the feeding device 65′ and may be fastened thereto by means of screws 82 via a rearwardly projecting flange 81. The feeding device 65′ is coupled to the feeding device 2 and they are moved together. The workpiece holder 32′ is provided with a guide rail 83 extending parallel to the main feed direction 78 and receiving a slidable carriage 84. The carriage is formed with an engaging piece 85 for a sewn workpiece 3. The carriage 84 is formed with a spindle nut 86 arranged on a drivable spindle 87 which extends parallel to the guide rail 83. The guide rail 83 is carried by an intermediate wall 90 formed at the flange 81 and an angular wall 89 of an outer wall 88 extending parallel to the main feed direction 78. The free end of the spindle 87 is supported in the wall 89. The walls 88, 89 form together with the flange 81 and the intermediate wall 90, the supporting frame of the feeding device 65′. A drive motor 91 for the spindle 87 is flanged to the intermediate wall 90. The RPM-rate and the number of rotations per working cycle of the drive motor 91 are controllable, so that the moving speed of the carriage 84 and its working stroke are also controllable. The drive motor 91 may be a DC motor or a stepping motor.

The engaging piece 85 projects into the path of the workpiece 3 and is formed with a driver rod 93 that presses on the workpiece 3 by means of a pneumatical piston-cylinder drive 92. The driver rod 93 is formed with a tip or is provided with a rubber coating or another coating material for ensuring a good contact between the drive rod 93 and the workpiece 3. This is necessary for moving the workpiece 3, provided with the seam 54, out of the workpiece holder 32′ and to the reel 43. The stitch length of the thread chain 80 is defined by the rate at which the workpiece 3 is pulled out of the workpiece holder 32′.

Figure 8:
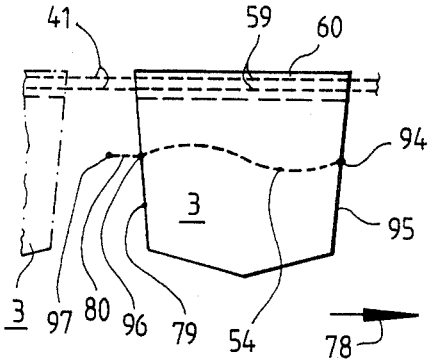
FIG. 8 shows a single seam produced in a pocket cut.

In FIG. 8 there is illustrated again how the contour of the seam—a decorative seam—extends from a starting point 94 at the leading edge 95 fed in the main feed direction 78 to a point 96 at the trailing edge 79. Subsequently, the thread chain 80 is produced, which, however is terminated at an end point 97, in order that the succeeding workpiece 3 will not be sewn prior to its positioning in the workpiece holder 32 respectively 32′.

Figure 9:
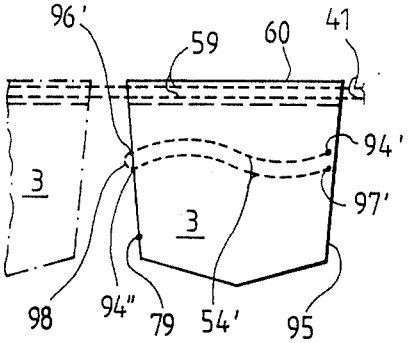
FIG. 9 shows a double seam produced in a pocket cut.

In FIG. 9 there illustrated, the production of a bidirected seam 54′. This is achieved by commencing sewing at a start point 94′ at the leading edge 95 towards a trailing edge point 96′, by producing a connecting seam 98 of a thread-chain-type outside the workpiece 3, and by sewing from a new start point 94″ at the trailing edge 79 towards an end point 97′, which can be placed at the leading edge 95. In contrast to the preferred embodiment, at this point a thread cutting cycle is required, so that the succeeding workpieces 3 are connected only together by the already existing thread chain 41.

We claim:

1. An automated sewing machine for successively sewing workpieces flexibly connected to one another by at least one thread chain, said sewing machine having:

a sewing head, a needle connected to the sewing head; and a feeding device for generating relative feed movement between said sewing head and said workpiece, said feeding device having:

a holder for receiving said workpiece to be provided with a seam and for guiding said workpiece along said seam;

said sewing machine comprising:

a first reel receiving said workpieces not yet provided with said seam, said first reel being positioned in front of said sewing head; and a second reel receiving said sewn workpiece positioned behind said sewing head.

2. An automatic sewing machine according to claim 1 wherein, said first reel has a stationary position relative to said workpiece holder.

3. An automatic sewing machine according to claim 2 wherein said first reel is arranged on said feeding device.

4. An automatic sewing machine according to claim 2 wherein said sewing machine further comprises:

a guiding device for said workpieces not yet provided with said seam, said guiding device being connected to said workpiece holder and said first reel.

5. An automatic sewing machine according to claim 4 wherein said guiding device has:

a guiding section resting against said workpieces being fed off said first reel;

and a supporting plate continuously formed with said guiding section and extending beneath said workpiece holder.

6. An automatic sewing machine according to claim 1, wherein adjacent said workpiece holder there is provided a guide means laterally guiding said workpiece to be sewn.

7. An automatic sewing machine according to claim 6, wherein said workpieces having a lateral hem and said guiding means comprising a canal for receiving and guiding said hem.

8. An automatic sewing machine according to claim 1, wherein said sewing head further comprising:

sensing means for sensing an edge of said workpiece.

9. An automatic sewing machine according to claim 1, further having:

a second feeding device arranged between said sewing head and said second reel, said second feeding device being provided to pulling said workpiece provided with said seam, and to pulling said workpiece to be provided with said seam into said workpiece holder.

10. An automatic sewing machine according to claim 9 wherein, said further feeding device is adjustable with respect to its feed rate.

11. An automatic sewing machine according to claim 9 wherein, said further feeding device has two driveable feed belts engagable with said workpiece at both sides of said seam.

12. An automatic sewing machine according to claim 9 wherein further feeding device has an engaging piece engagable on said workpiece, said engaging piece being linearly drivable.

* * * * *